US005353485A

United States Patent [19]

Billgren et al.

[11] Patent Number: 5,353,485

[45] Date of Patent: Oct. 11, 1994

[54] METHOD AND AN ARRANGEMENT FOR PRODUCING SPUNLACE MATERIAL, AND MATERIAL PRODUCED THEREBY

[75] Inventors: Tomas Billgren, Kullavik; Jeanette Hellström, Göteborg, both of Sweden

[73] Assignee: Molnlycke AB, Goteborg, Sweden

[21] Appl. No.: 50,105

[22] PCT Filed: Nov. 18, 1991

[86] PCT No.: PCT/SE91/00779

§ 371 Date: May 11, 1993

§ 102(e) Date: May 11, 1993

[87] PCT Pub. No.: WO92/08832

PCT Pub. Date: May 29, 1992

[30] Foreign Application Priority Data

Nov. 19, 1990 [SE] Sweden ..... 9003676-5

[51] Int. Cl.[5] ..... D04H 1/46

[52] U.S. Cl. ..... 28/104; 492/35

[58] Field of Search ..... 28/104, 105; 29/895.3, 29/895.32, 895.211, 895.21, 895; 492/35

[56] References Cited

U.S. PATENT DOCUMENTS

| | | | |
|---|---|---|---|
| 1,802,003 | 4/1931 | Connelly | 492/35 X |
| 2,793,585 | 5/1957 | Granitsas | 492/35 X |
| 3,800,364 | 4/1974 | Kalwaites | 28/105 |
| 3,974,554 | 8/1976 | Fantuzzo | 492/35 X |
| 4,805,275 | 2/1989 | Suzuki et al. | 28/104 |
| 5,115,544 | 5/1992 | Widen | 28/105 |
| 5,137,600 | 8/1992 | Barnes et al. | 28/105 X |

FOREIGN PATENT DOCUMENTS

| | | |
|---|---|---|
| 0108621 | 5/1984 | European Pat. Off. . |
| 1435125 | 10/1974 | Fed. Rep. of Germany . |
| 429350 | 8/1983 | Sweden . |
| 431567 | 2/1984 | Sweden . |
| 2114174 | 8/1983 | United Kingdom . |

*Primary Examiner*—Clifford D. Crowder
*Assistant Examiner*—John J. Calvert
*Attorney, Agent, or Firm*—Young & Thompson

[57] ABSTRACT

The present invention relates to a method for producing spunlace material in which there is formed a fibrous web by air-laying a layer of fibres of staple length on a forming wire and air-laying a layer of short fibres on top of the layer of staple fibres. According to the invention, the fibrous web is passed to an entangling wire 18 on which there is arranged at least one elongated element 17 whose diameter is much greater than the diameter of the wires 16 in the entangling wire 18, whereafter the fibrous web is entangled. The invention also relates to an arrangement for carrying out the method, and to a spunlace material produced in accordance with the method.

5 Claims, 2 Drawing Sheets

METHOD AND AN ARRANGEMENT FOR PRODUCING SPUNLACE MATERIAL, AND MATERIAL PRODUCED THEREBY

FIELD OF THE INVENTION

The present invention relates to a method and to an arrangement of apparatus for producing spunlace material, and also to spunlace material produced thereby. The invention relates in particularly, but not exclusively, to spunlace material which is suitable for use in the casing layers of an absorbent, disposable article, such as a diaper, an incontinence guard, etc.

BACKGROUND OF THE INVENTION

Spunlace material consists of mechanically bonded non-woven fabric in which interlocking of the fibres and the fibre structure are obtained by entangling the fibres of a fibrous web with the aid of thin jets of air or liquid, i.e. the structure is obtained by means of a so-called entangling process. The present application is concerned solely with spunlace material produced by hydroentangling, i.e. entangling that is achieved with the aid of liquid jets. Such material has pronounced textile-like properties in comparison with other nonwoven fabrics, and also affords a relatively high degree of flexibility to the method of manufacture with regard to the properties of the material produced, owing to the fact that the properties of said material can be varied to a great extent through the appropriate selection of fibres, fibre mixtures, fibre forming, degree of entanglement, the structure of the entangling wires used, etc. As a result, the use of spunlace material has become more and more usual.

Such material can be used effectively to wipe-up or absorb liquid, and also to spread or to disperse liquid that comes into contact therewith. Another area in which spunlace material can be used is found in the casing layers of disposable absorbent articles, where the textile-like structure of the material is felt by the consumer to be more friendly to the skin than other types of nonwoven materials, which are often felt to have a "plastic" texture.

SUMMARY OF THE INVENTION

The present invention relates to a method and an arrangement for producing spunlace material which can be used advantageously as a liquid-spreading layer or as the casing layer of a liquid-absorbent disposable article, and also to a spunlace material produced in accordance with the method and possessing liquid-spreading or liquid-dispersing properties.

The inventive method comprises air-laying a layer of fibres of staple length on a forming wire and air-laying a layer of short fibres on top of the layer of staple fibres, such as to form a fibrous web, and is characterized by transferring the fibrous web to an entangling wire on which there is arranged at least one elongated element whose diameter is considerably larger than the diameter of the wires from which the entangling wire is formed, and entangling the fibrous web on said wire. As the web is entangled, an elongated string consisting solely of staple fibres is formed with each part of spunlace material produced, which during the entangling process has lain over an elongated element located on the entangling wire. Thus, when several such elongated elements are placed on the entangling wire, the material obtained will have a striped configuration, in that the short fibres are collected in the troughs or dales between the elongated elements and because solely staple fibres remain on the tops of said elements. When this process included the use of hydrophobic staple fibres and hydrophilic short fibres, for instance pulp fibres, and when there is used an entangling wire whose mesh size is such that the manufactured spunlace material will be perforated with holes, the material obtained will be permeable to liquid and will spread or disperse liquid in its longitudinal direction. Such a material is particularly suitable for use as a liquid spreading layer of a disposals absorbent article, such as a disposable diaper, sanitary napkin or the like, for increasing the dispersal of liquid in the longitudinal direction of the article, such longitudinal dispersal of liquid being necessary in order to utilize the absorbency of the absorbent pad to the full.

According to one embodiment of the invention, the staple fibres are elastic fibres. This provides a spunlace material which is elastic solely within those parts which contain only staple fibres, since stretching of the elastic fibres in other parts is prevented by the binding of said fibres to the pulp fibres. Furthermore, it has been found that the staple fibres in the regions between elongated strings of pulp and staple fibres of the entangled material are directed generally transversal to these strings. This enables the direction of stretch of the finished material to be controlled, by varying the alignment of the elongated elements relative to the arrangement direction.

The inventive arrangement for producing spunlace material includes a forming unit having a staple-fibre former and a short-fibre former which function to air-lay a layer of staple fibre on a forming wire and to air-.lay a layer of short fibres on the staple-fibre layer, such as to form a fibrous web, and an entangling unit for hydro-entangling the fibrous web. The arrangement is characterized in that the entangling unit includes an entangling wire having arranged thereon at least one elongated element whose diameter is much greater than the diameter of the wires from which the entangling wire is constructed.

A spunlace material produced in accordance with the invention is characterized in that it is constructed from short fibres and fibres of staple lengths, and includes at least one elongated material string which contains solely staple fibres.

BRIEF DESCRIPTION OF THE DRAWINGS

So that the invention will be more readily understood and further features thereof made apparent, the invention will now be described in more detail with reference to an exemplifying embodiment thereof and also with reference to the accompanying drawings, in which.

DETAILED DESCRIPTION OF THE INVENTION

The spunlace material manufactured in accordance with the described embodiment is composed of dry-defibred pulp fibres and hydrophobic staple fibres, said staple fibres consisting of polyester fibres which have a length of 20–50 mm.

Figure 1:
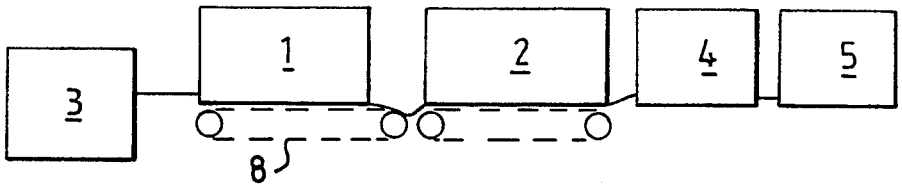
FIG. 1 is a block schematic of an arrangement of apparatus for manufacturing spunlace material.

Illustrated in FIG. 1 is a spunlace material manufacturing arrangement which includes a forming station 1 and an entangling station 2. The arrangement may also include a station 3 for treating staple fibres, for instance preparatory carding, a station 4 for subsequent treatment of the spunlace material produced, a reeling-up station 5 at which the spunlace material is reeled-up into rolls.

The forming station 1 includes a staple-fibre former 6 and a pulp-fibre former 7, which may be of any known kind and which function to air-lay a respective layer of staple fibres and pulp fibres on an underlying forming wire. The entangling station 2 includes a number of rows of nozzles having a diameter of 70–130 μm, from which water is sprayed under pressure onto an underlying entangling wire.

Figure 2:
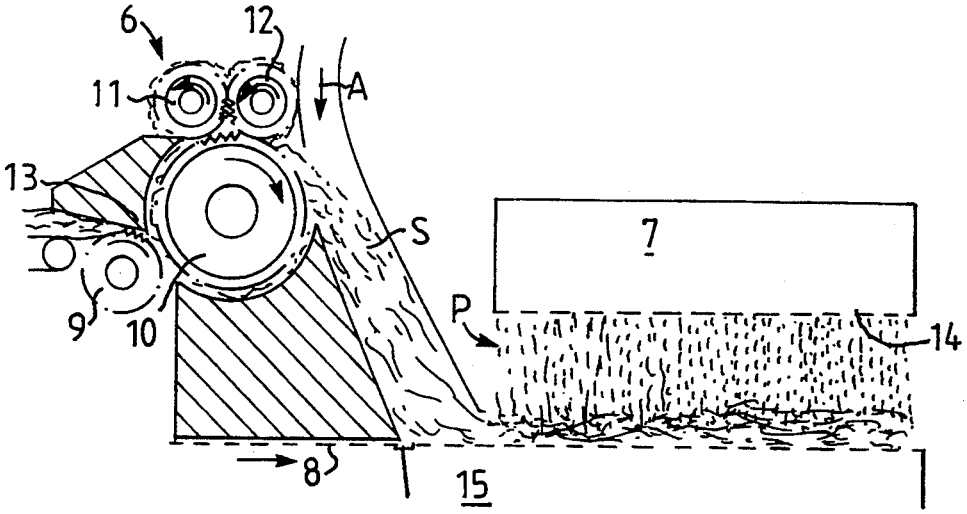
FIG. 2 is a sectioned view from one side of a forming station included in the arrangement shown in FIG. 1.

FIG. 2 illustrates a preferred embodiment of an inventive forming station.

The staple-fibre former 6 shown in FIG. 2 includes a feed roller 9 which transfers a coarsely-opened mat of staple fibres to a carding roll 10. Opened and individualized staple fibres are slung from the periphery of the carding roll 10 through the combined action of centrifugal force, generated by rotation of the carding roll, and an air stream, symbolized by the arrow A in FIG. 2. This air stream is directed tangentially to the carding roll at the location where the staple fibres are slung from the roll. The staple-fibre former also includes two auxiliary rolls, a stripper 11 and a worker 12.

The staple-fibre former 6 illustrated in FIG. 2 operates in the following manner.

A mat of coarsely-opened staple fibres is fed by the toothed feed roller 9 into the nip defined between the periphery of the roller 9 and a counter-pressure device 13, a so-called nose-bar. The carding roller 10, which is provided with teeth or like combing devices, grips the forwardly advanced mat and entrains the mat. The undermost fibres in the transferred, coarsely-opened fibre mat are therewith combed-out effectively by the teeth of the carding roller. As the mat is transferred from the feed roller to the carding roller, the mat is forced to pass around the pointed edge of the nose-bar 13, thereby facilitating opening and individualizing of respective staple fibres. The uppermost fibres in the transferred fibre mat are not opened and individualized equally as well as the underlying fibres, and will be gripped by the worker 12, which together with the stripper rotates at a slower speed than the carding roller 10. The fibres captured by the worker are transferred to the stripper 11 and are laid back by the stripper on the carding roller 12. The worker and the stripper are also provided with teeth or similar combing devices and the fibres which have been opened and individualized to the worst extent and which are caught by the working-stripper pair will thus be further opened and individualized through the action of the teeth on these rollers. Those fibres which pass between the worker and the carding roller and which are thereafter slung from the periphery of the carding roller by the centrifugal force generated are therefore fully opened and individualized.

The function of the air stream A is to air-carry those staple fibres which are slung from the periphery of the carding roller to an underlying forming wire 8.

It will be obvious from the aforedescribed manner of operation of the staple-fibre former that the former operates generally in accordance with conventional and commercially available staple-fibre formers, e.g. of the type Fehrer K21, etc., which can therefore be used beneficially in the inventive arrangement.

The forming station also includes a pulp former 7 of the kind capable of casting pulp fibres P through a steel net 14 or the like.

As illustrated in FIG. 2, the staple fibres S are the first to be laid on the forming wire 8, whereafter the pulp fibres P are laid on top of the layer of staple fibres. The air-laid fibres are retained on the wire 8 with the aid of a subpressure generated in a suction box 15, only the end walls of which are shown in FIG. 2.

The fibrous web formed in the forming station is then passed into the entangling station 2 and there subjected to a first entangling process at a low to medium pressure. In this first entangling process, the staple fibres and pulp fibres in the fibrous web are mutually bound to an extent such as to enable the fibrous web to withstand a following, second entangling process at a high pressure, without pulp fibres being flushed away or the fibrous web disintegrating.

Figure 3:
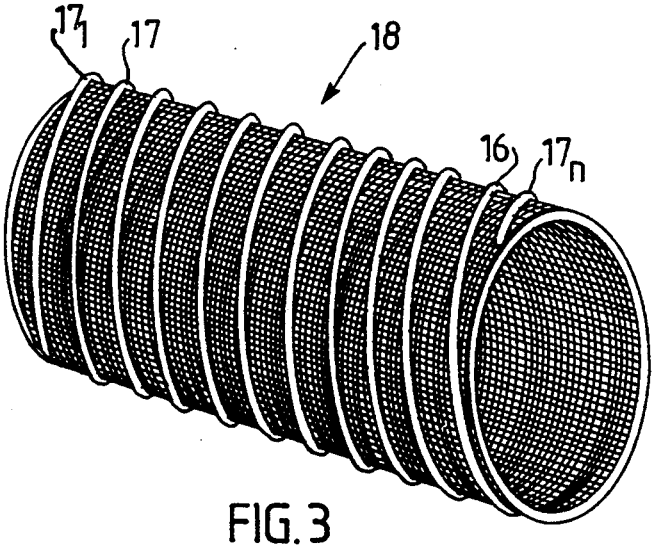
FIG. 3 is a perspective view of an entangling wire according to one preferred embodiment of the invention.
Figure 4:
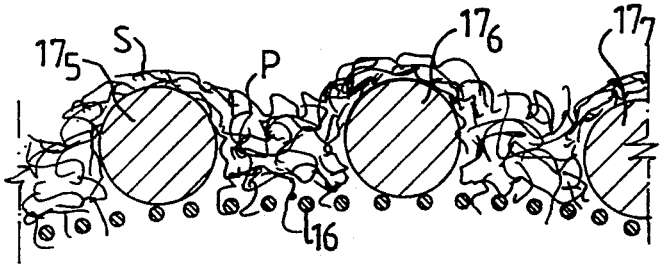
FIG. 4 is an axial cross-section view of part of the entangling wire shown in FIG. 3, in a much greater scale.

FIGS. 3 and 4 illustrate schematically a preferred embodiment of an entangling wire 18 which can be used advantageously in the second, high-pressure entangling process. This entangling wire consists of a cylindrical net 16 which is mounted for rotation in some suitable manner (not showing in the Figure) beneath the water-jet nozzles in the entangling station. A wire 17 is wound helically around the cylindrical surface of the net 16 and fastened thereto, at least at the ends of the wire. As will be seen from FIGS. 3 and 4, the diameter of the wire 17 is much greater than the diameter of the wires forming the net 16. The distance between the turns of the helically wound wire 17 are exaggerated in FIG. 3. This distance is suitably equal to from one to ten times the diameter of the wire 17.

Subsequent to being subjected to the first entangling process at a low to medium pressure (60–100 bars), the fibrous web is transferred to the entangling wire 18 and is there entangled at a high pressure (80–250 bars). The water emanating from the water jets which strike the elongated elements $\mathbf{17}_1$–$\mathbf{17}_n$ formed by the helically wound wire 17 passes down the sides of said elongated elements and carries therewith those parts of the pulp fibres which were initially located on the upper side of the elongated elements $\mathbf{17}_1$–$\mathbf{17}_n$. The pulp fibres will therefore be collected in the troughs or dales between mutually defining elongated elements $\mathbf{17}_1$–$\mathbf{17}_n$, for instance between the elements $\mathbf{17}_5$–$\mathbf{17}_6$ and $\mathbf{17}_6$–$\mathbf{17}_7$ respectively, as illustrated schematically in FIG. 4. Due to their greater length in relation to the pulp fibres, the separated staple fibres will be bound to each other and to pulp fibres at several positions along their lengths and are therefore, in total, much more difficult to move than the pulp fibres. Consequently, the staple fibres will not be passed down into the dales or troughs between adjacent elongated elements, but will remain on the tops or upper surfaces of said elements. It is true that a few free ends of the staple fibres may be pressed down into the dales between the elongated elements, but since the staple fibres as a whole cannot be moved by the water flowing down the sides of the elongated elements, movement of any free ends of the staple fibres on the tops of the elongated elements will essentially be a bending movement and consequently the majority of these free ends will engage other staple fibres during said bending movement and be bound together with said staple fibres prior to leaving the tops of the elongated elements.

Entangling takes place in a typical manner in the dales between adjacent elongated elements, i.e. the permeability of the wire net 16 to liquid is sufficient for the water in the liquid jets to flow unhindered through the net subsequent to having delivered a large part of their kinetic energy to the fibres in the fibrous web. It is pointed out that as a result of its circular form, the helically wound wire will decrease the open area of the wire, and therewith the inherent liquid permeability thereof, to only a small degree.

The staple fibres can be laid in a layer of such thinness that subsequent to the second entangling process, the fibrous web will present holes in the strings of solely staple fibres formed along the upper sides of the elongated elements.

Subsequent to having passed the entangling station 2, the formed spunlace material passes through the after-treatment station 4, where the material is dried and optionally subjected to further treatment, such as dying or surface treatment. The spunlace material is then rolled onto rollers in the reeling station 5.

The preferred spunlace material will therewith be striped, i.e. contain outwardly protruding strings of mixed pulp and staple fibres between strings of solely staple fibres. Such a material can be used advantageously as a liquid-permeable casing layer of an absorption pad, because the strings of pulp fibres and staple fibres are able to spread or disperse liquid in their longitudinal directions. This enables a major part of the absorbent pad to be utilized in absorbing liquid deposited thereon, therewith reducing the risk of the absorbent pad being locally saturated and also reducing the risk of leakage associated with such saturation. The use of an inventive spunlace material as the liquid-spreading layer in an absorbent, disposable article thus enables the total liquid absorption capacity of the absorbent pad to be used more effectively.

As will be understood, the aforedescribed spunlace material can also be used for drying purposes, or as a liquid-spreading layer in other fields where the spreading or dispersion of liquid in a given direction is desirable.

The aforedescribed method and arrangement according to the invention also enables a material of controlled elasticity to be produced, i.e. a material which can be stretched in a specific direction. Such a material is obtained when the staple fibres consist of elastic fibres. It has been found that in those parts of the material which contain solely staple fibres, these fibres will be oriented generally transversely to the longitudinal elements, due to longitudinally extending staple-fibre parts being flushed down into the dales or troughs between the elongated elements, in the same manner as the pulp fibres, or are given a transverse alignment by the flowing water. In the strings of pulp fibres and staple fibres, the material will be generally inelastic, irrespective of whether the staple fibres are elastic or not, since the staple fibres are there bound to the inelastic pulp fibres. It will be seen that by using elastic staple fibres in accordance with the inventive method, there is obtained a material which is stretchable in its transversal direction relative to the elongated elements. Since the alignment of the elongated elements relative to the arrangement direction can be varied by up to ±45°, it is possible to control the direction of stretch to a high degree, by appropriate positioning of the elongated elements.

According to one variant of this embodiment of the invention, the elastic fibres may consist of heat-shrinkable bicomponent fibres which become elastic after being shrunk. Such elastic fibres can be used to produce a material according to the invention in which the distance between the strings of pulp and staple fibres is very small, and even zero.

It will be understood that the aforedescribed methods can be varied within the scope of the inventive concept. For example, instead of the helically wound wire, which produces elongated elements which extend in a direction slightly inclined to the arrangement direction, one or more elongated elements can be attached to the underlying wire in an appropriate fashion, this wire then preferably being a flat wire, without sloping relative to the arrangement direction. Furthermore, the elongated elements may have a cross-sectional shape other than circular, even though this shape is particularly suitable with regard to liquid flow and liquid permeability. The elongated elements may also be given an undulating configuration, e.g. a sinusoidal configuration, or may be given a discontinuous or continuous herringbone pattern. The extent to which short fibres are flushed or rinsed from the tops of the elongated elements can be varied both in respect of differently manufactured material and with respect to the same material, by varying the diameter of the elongated elements. Furthermore, the elongated elements need not extend over the whole of the wire, enabling "striped" spunlace material to be produced with discontinuous stripes. Neither need the elongated elements be inclined at the same angle to the arrangement direction.

It will be seen that the inventive method can be applied in the manufacture of other types of spunlace material than the material according to the described embodiment. For example, the inventive method can be applied to produce liquid-impermeable strings of solely staple fibres and liquid-impermeable parts of mixed short fibres and staple fibres, on the basis of hydrophilic short fibres and hydrophobic staple fibres, by suitable selection of the mesh size of the wire. The invention is therefore only restricted by the contents of the following claims.

We claim:

1. A method for producing spunlace material which comprises: forming a fibrous web by air-laying a layer of fibres of staple length on a forming wire and by air-laying a layer of short fibres on top of the layer of staple fibres, providing an entangling wire on which there is arranged at least one elongated element whose diameter is significantly greater than the diameter of the wires from which the entangling wire is constructed, and wherein said at least one elongated element comprises a helically wrapped longitudinally extending wire forming mutually parallel wires ($17_1$–$17_n$) of circular cross section arranged on the entangling wire (18), transferring the fibrous web to said and subsequently entangling wire, entangling the fibre web.

2. An arrangement for producing spunlace material, comprising a forming unit (1) including a staple-fibre former (6) and a short-fibre former (7) including a to air-lay a layer of staple fibre on a forming wire (8) and to lay a short-fibre layer on top of said staple-fibre layer, and further comprising an entangling unit (2) for entangling the fibrous web under high pressure, said entangling unit (2) includes an entangling wire (18) on which there is arranged at least one elongated element (17) whose diameter is significantly greater than the diameter of the wire (16) from which the entangling wire (18) is constructed, said at least one elongated element comprising a wrapped longitudinally extending wire forming mutually parallel wires ($17_1$–$17_n$) of circular cross-section arranged on the entangling wire (18).

3. An arrangement according to claim 2, wherein the longitudinally extending wires are inclined relative to the arrangement direction.

4. An arrangement according to claim 3, wherein the entangling wire (18) has the form of a hollow cylinder (16), and the longitudinally extending, mutually parallel wires consist of a single wire (17) which is wound helically around the peripheral surface of the entangling wire.

5. An arrangement according to claim 2, further including a plurality of elongated elements, said elements being inclined at different angles to the arrangement direction.

* * * * *